US007168975B2

(12) United States Patent
Kuo

(10) Patent No.: US 7,168,975 B2
(45) Date of Patent: Jan. 30, 2007

(54) POWER CONNECTOR WITH LIGHT INDICATOR

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,900

(22) Filed: Dec. 30, 2005

(65) Prior Publication Data

US 2006/0286854 A1 Dec. 21, 2006

(30) Foreign Application Priority Data

May 31, 2005 (CN) ..... 200520072286

(51) Int. Cl.
*H01R 3/00* (2006.01)

(52) U.S. Cl. ..... 439/490; 439/580

(58) Field of Classification Search ..... 439/490, 439/580, 489, 668

See application file for complete search history.

(56) References Cited

U.S. PATENT DOCUMENTS 4,902,092 A * 2/1990 Grandy ..... 385/56
5,170,067 A * 12/1992 Baum et al. ..... 307/10.1
5,520,553 A * 5/1996 Cecil et al. ..... 439/595
5,690,509 A * 11/1997 Eisenbraun ..... 439/490
6,165,006 A * 12/2000 Yeh et al. ..... 439/490
6,290,539 B1 * 9/2001 Wilber et al. ..... 439/595
6,361,357 B1 * 3/2002 Stillwell et al. ..... 439/490
6,485,338 B1 * 11/2002 Wu ..... 439/862
6,572,402 B2 * 6/2003 Lin ..... 439/490
6,595,792 B1 * 7/2003 Rudolph et al. ..... 439/345
6,705,901 B1 * 3/2004 Lin ..... 439/668
6,733,333 B1 5/2004 Chen
6,938,488 B2 * 9/2005 Diaz et al. ..... 73/597

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

A power connector (100) can mate with a complementary connector and includes a mating plug (1) matable with the complementary connector, a circuit board (2) connected to the mating plug, a light-emitting diode (4) assembled to the circuit board to indicate working status of the power connector and a light pipe (6) transmitting the light from light-emitting diode. The mating plug includes first and second terminals (12, 13) for power transmission.

10 Claims, 9 Drawing Sheets

POWER CONNECTOR WITH LIGHT INDICATOR

BACKGROUND OF THE INVENTION

1. Field of the Invention

The present invention relates to an electrical connector, and more particularly to a power connector for power transmission.

2. Description of Related Art

Power jacks/plugs are widely used in the electrical industry to connect power supplies with electrical devices, such as mobile phone, note book. The power jack generally is mouted to a Printed Circuit Board (PCB). The power plug is connectable with a cable and comprises a dielectric housing, an inner contact and an outer contact respectively served as a positive pole and a negative pole of a power supply for powering electrical device connecting to the power connector, and a signal contact provided for signal transmission. In mating, a current flowing between the power plug and the PCB to which the power jack is mounted is achieved. To assure stable electrical connection between the power plug and the PCB, it is necessary to equip the power plug with an indicator to indicate to the work state. So as to quickly identify the problem and keep the downtime to the minimum. To identify a transmission fault, it must be checked whether current is being transmitted or not. However, conventionally, it is difficult to identify such transmission fault, since no indicating device is employed or indicating device can not be seen obviously.

Hence, an improved power plug is required to indicate the current transmitting status of the power plug.

SUMMARY OF THE INVENTION

Accordingly, the object of the present invention is to provide a power connector with a light indicator indicating the working status of the power connector.

In order to achieve the objects set forth, a power connector in accordance with the present invention can mate with a complementary connector and comprises a mating plug matable with the complementary connector, a circuit board connected to the mating plug, a light-emitting diode assembled to the circuit board to indicate working status of the power connector and a light pipe transmitting the light from light-emitting diode. The mating plug comprises first and second terminals for power transmission.

Other objects, advantages and novel features of the invention will become more apparent from the following detailed description when taken in conjunction with the accompanying drawings.

DETAILED DESCRIPTION OF THE INVENTION

Figure 1:
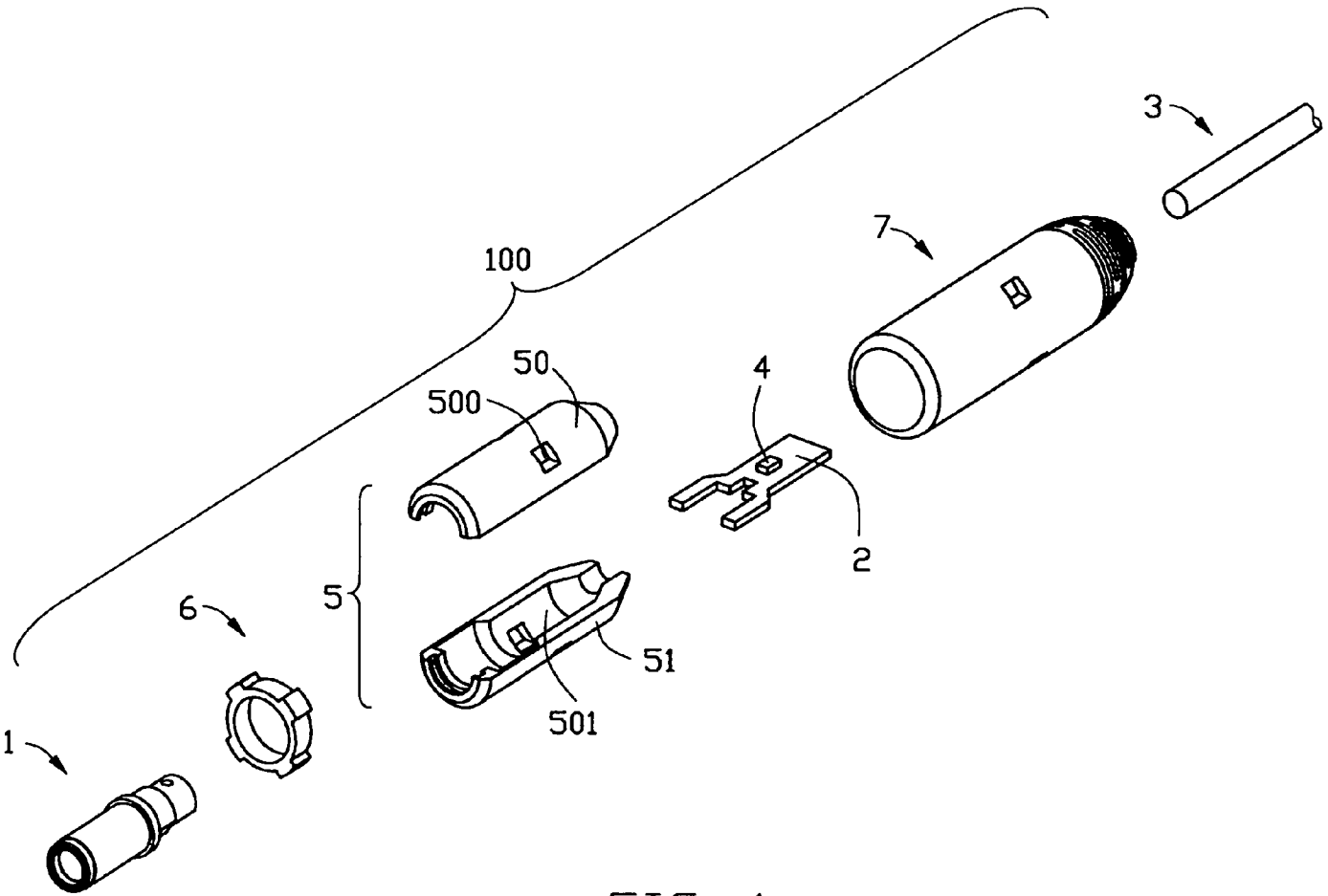
FIG. 1 is an explored, perspective view of a power connector in accordance with the first embodiment of the present invention.
Figure 2:
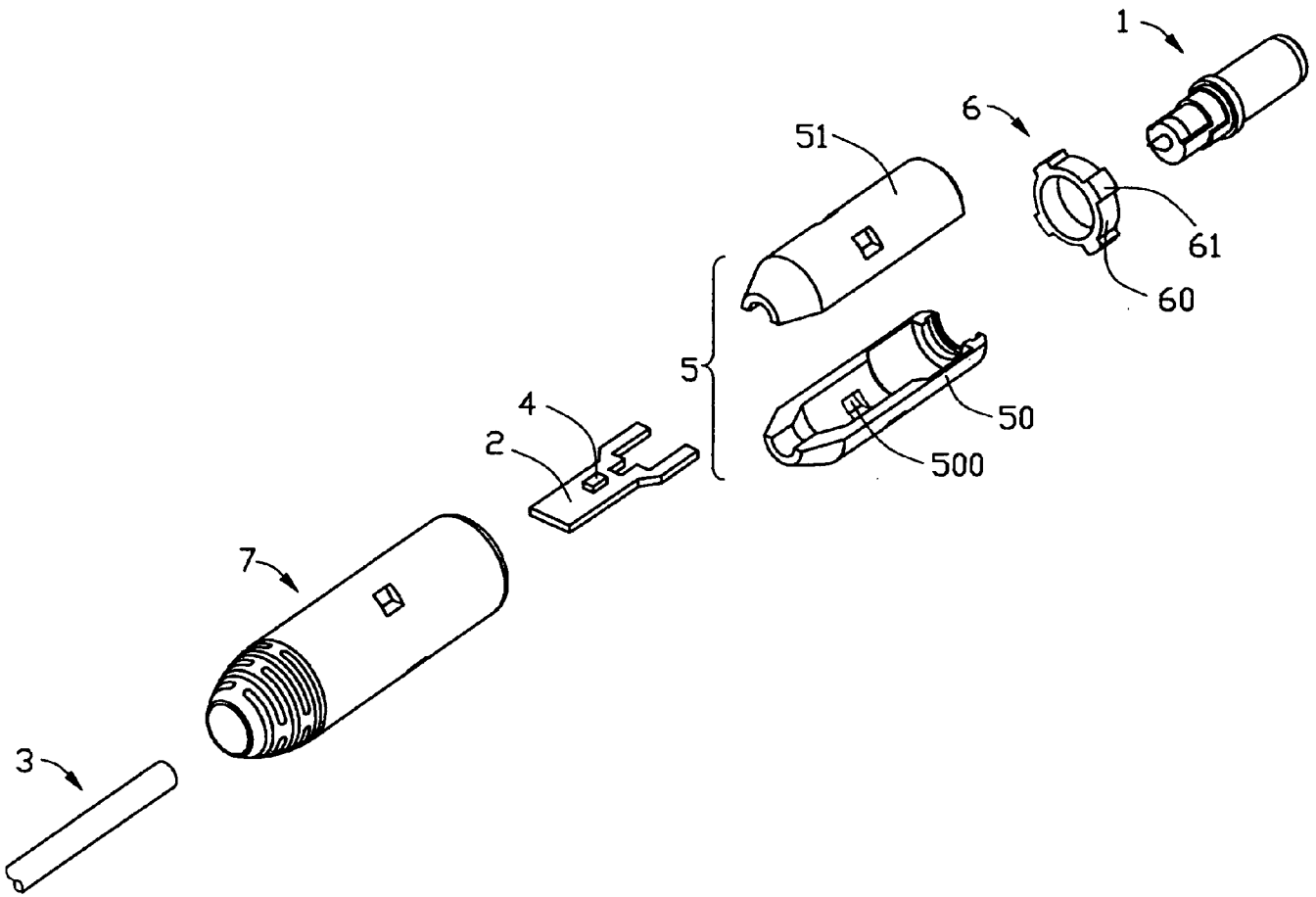
FIG. 2 is a view similar to FIG. 1, but viewed from another aspect.

Reference will now be made in detail to the preferred embodiment of the present invention.

referring to FIG. 1 and FIG. 2, a power connector 100 in accordance with the first embodiment of the present invention comprises a mating plug 1, a circuit board 2 connected to the mating plug 1, a cable 3 having a plurality of conductors (not shown) electrically connected with the circuit board 2, a light-emitting diode (LED) 4 assembled to the circuit board 2, a hollow column inner insulator 5, a light pipe 6 attached to inner face of the inner insulator 5 and an insulative outer cover 5 covering the inner insulator 5. The light-emitting diode 4 and the light pipe 6 together form a light indicator of the power connector 100 to indicate the working status of the power connector 100.

Figure 3:
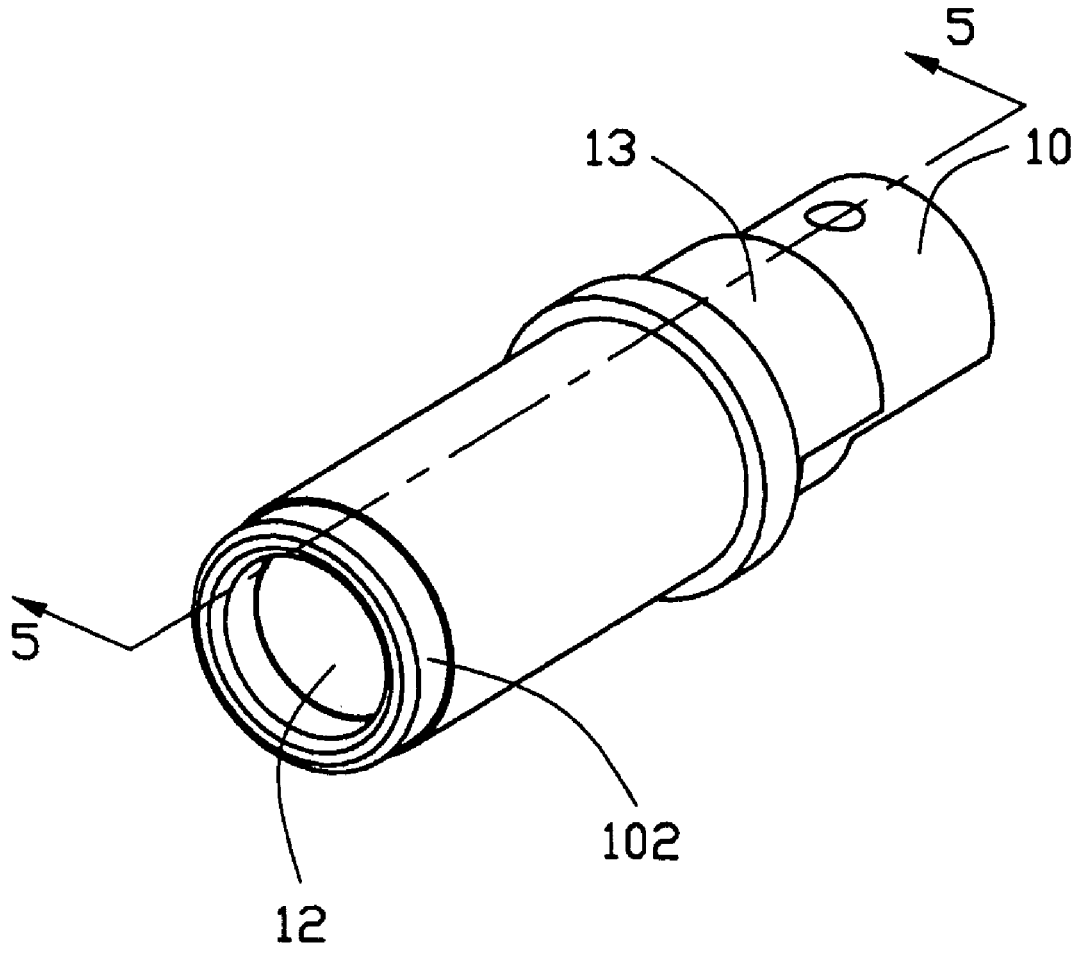
FIG. 3 is an enlarged view of a mating plug shown in FIG. 1.
Figure 4:
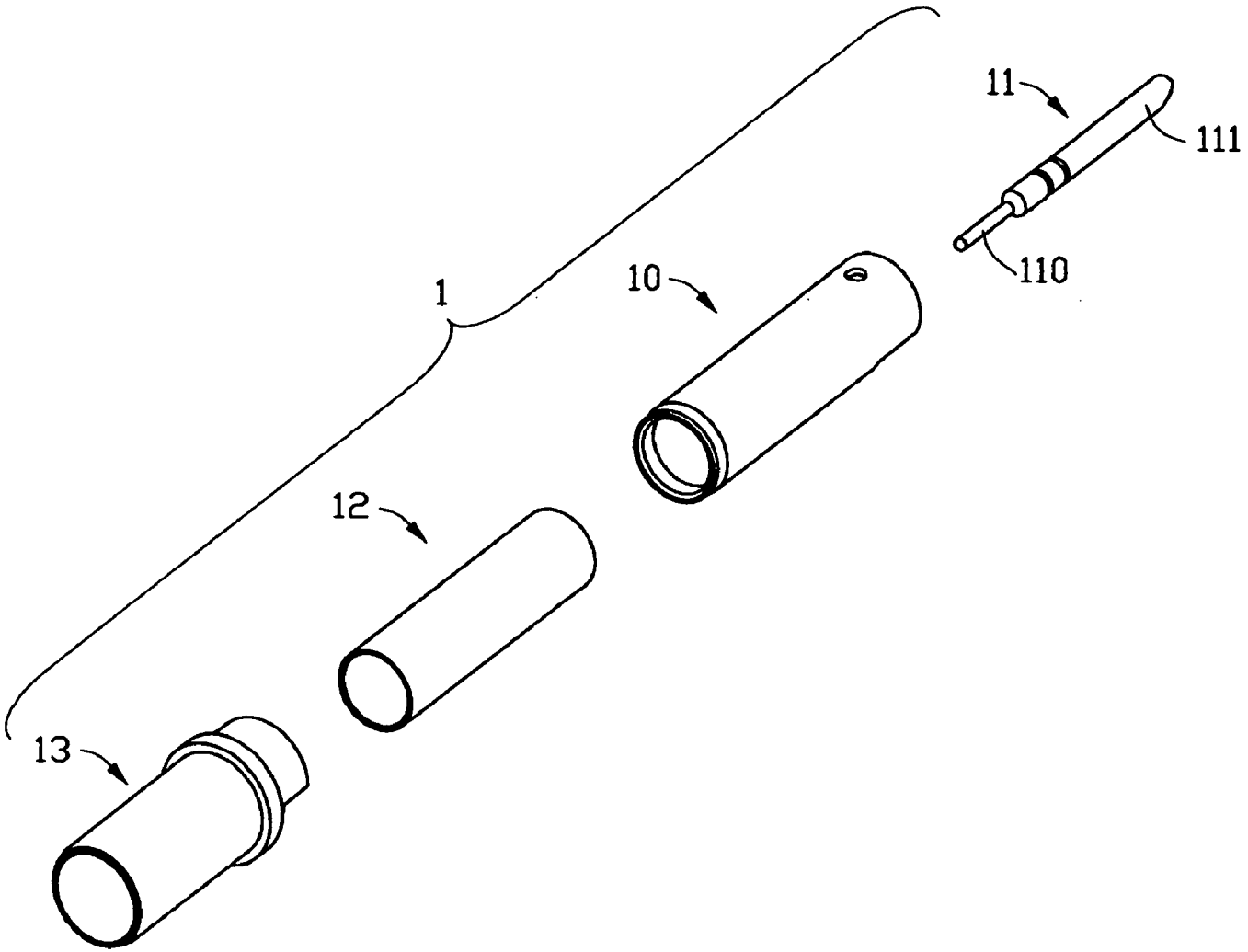
FIG. 4 is an explored, perspective view of FIG. 3.
Figure 5:
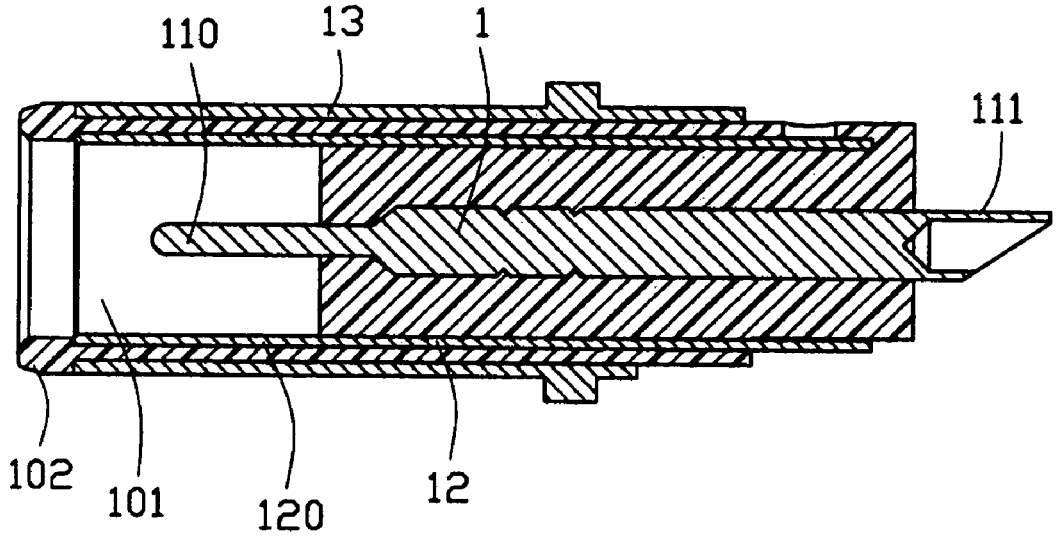
FIG. 5 is a cross-sectional view of FIG. 3 along line 5—5.
Figure 6:
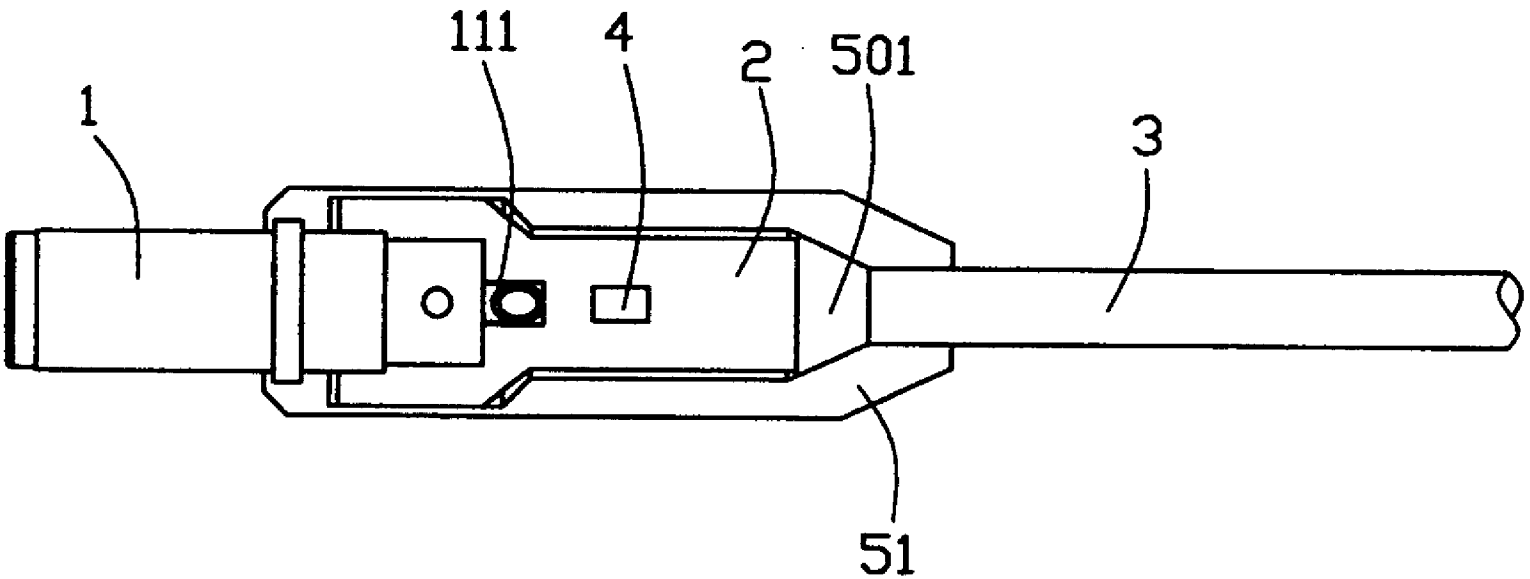
FIG. 6 is a partially assembled view of FIG. 1.

Referring to FIG. 3 to FIG. 5, the mating plug 1 is connected to the circuit board 2 in a jumper manner. The mating plug 1 comprises a cylindrical dielectric housing 10, a center signal terminal 11 assembled to the housing 10, a first terminal 12 attached to inner surface of the housing 10 and a second terminal 13 sheathing over the housing 10. The housing 10 defines a receiving cavity 101 at a front portion thereof. A flange 102 is formed along outer periphery of a front edge of the housing 10. The center signal terminal 11 is used for signal transmission and comprises a contacting portion 110 protruding into the receiving cavity 101 and a connecting portion 111 rearwardly extending from the contacting portion 110 beyond the housing 10. The first and second terminals 12, 13 are configured in metal sleeves with different diameters. The first terminal 12 is functioned as a positive pole of the power connector 100, with front portion thereof attached to the inner surface of the receiving cavity 101 to form a contacting portion 120 contacting with a corresponding portion of the complementary connector. The second terminal 13 is served as a negative pole. The second terminal 13 sheathes over the housing 10 with a front edge thereof abutting against the flange 102 of the housing 10.

Referring to FIG. 1 and FIG. 2 again, the inner insulator 5 is composed of symmetrical upper and lower halves 50, 51. The upper and lower halves 50, 51 respectively define a semicircular space 501 and a pair of rectangular through apertures 500 in communication with the space 501. Specially, the pair of apertures 500 are located along a common circle and spaced from at 90 degree interval each other.

Figure 7:
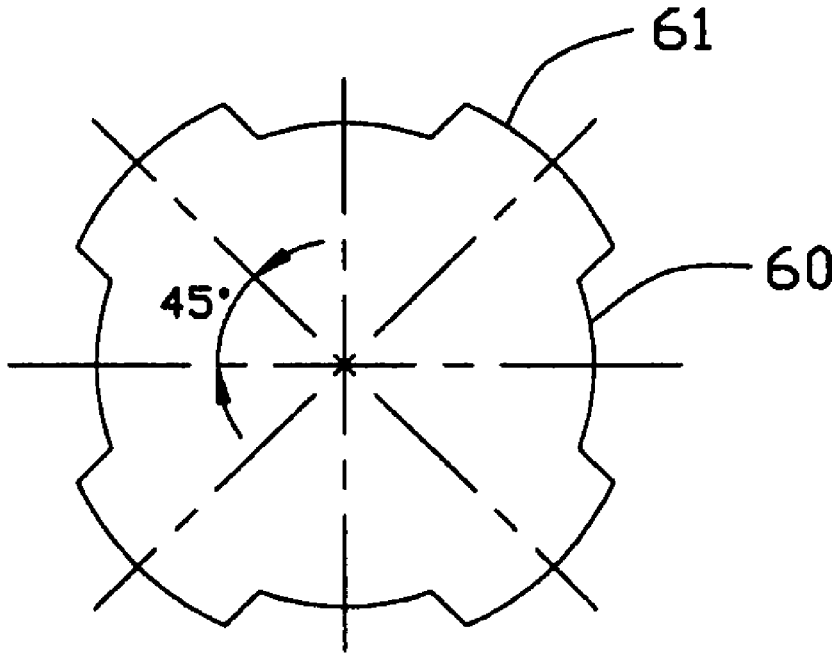
FIG. 7 is a view illustrating configuration of a light pipe shown in FIG. 1.
Figure 8:
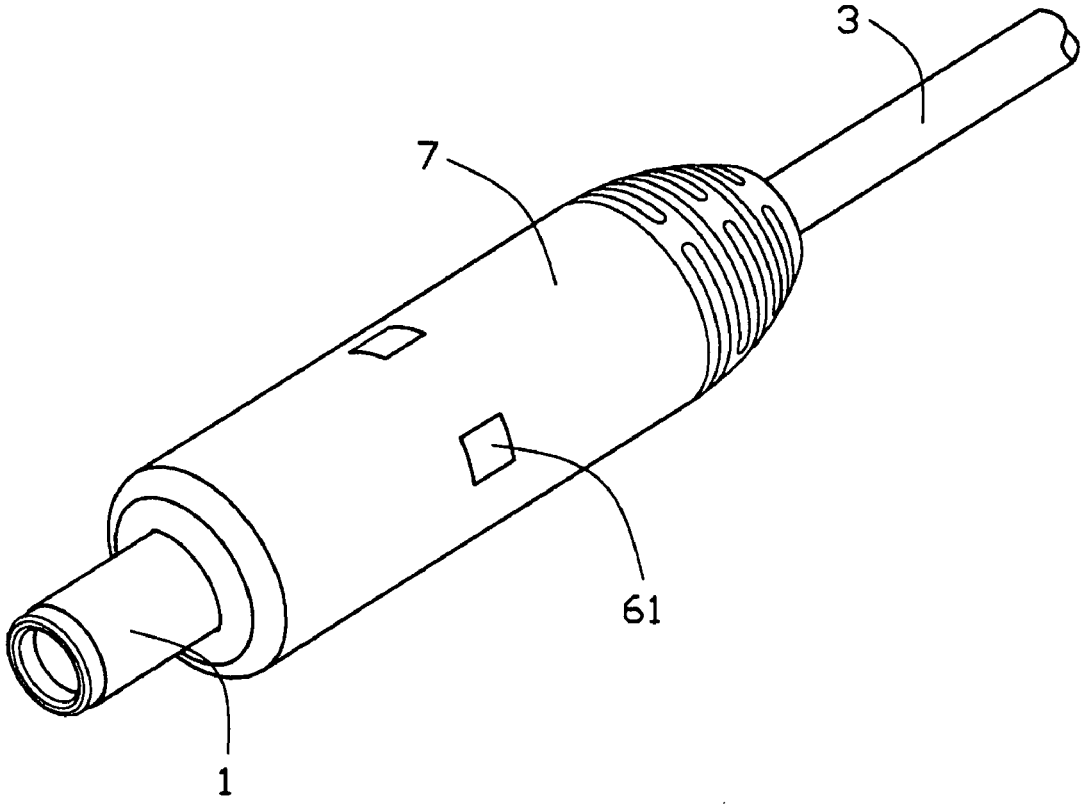
FIG. 8 is an assembled, perspective view of FIG. 1.

In the present embodiment, the visual angle of the LED 4 is 45 degree. The light pipe 6 is made of plastic or glass (silicon dioxide) fiber with thickness no thicker than a human hair and used to transmit the light from the LEDs 4 to the outer cover 7. Particularly referring to FIG. 7 and in conjunction with FIGS. 1–2, the light pipe 6 snaps onto the inner surface of the inner insulator 5. For increasing the apparent brightness and viewing angle of the LEDs 4, the light pipe 6 is designed to have a cylindrical base portion 60 attached to the inner face of the inner insulator 5 and four view sections 61 averagely spaced arranged on the base portion 60 and outwardly protruding from outer periphery of the base portion 60. The view sections 61 respectively pass trough the corresponding apertures 500 of the inner insulator 5, thus enchasing the engagement between the light pipe 6 and the inner insulator 5. The circuit board 2 with LEDs 4 thereon is then fittingly positioned in the space 501 in a position, where the LEDs 4 are positioned in the center of the light pipe 6. Because there is no physical connection between the light pipe 6 and the LEDs 4, the circuit board 2 can be easily installed or removed during repairing of the power plug 100. Since there are four averagely spaced view sections 61, the light pipe 6 could disperse the light from the LEDs 4 up to 360 degree, thus, the user could view the status of the LEDs 4 from all of the angles.

Figure 9:
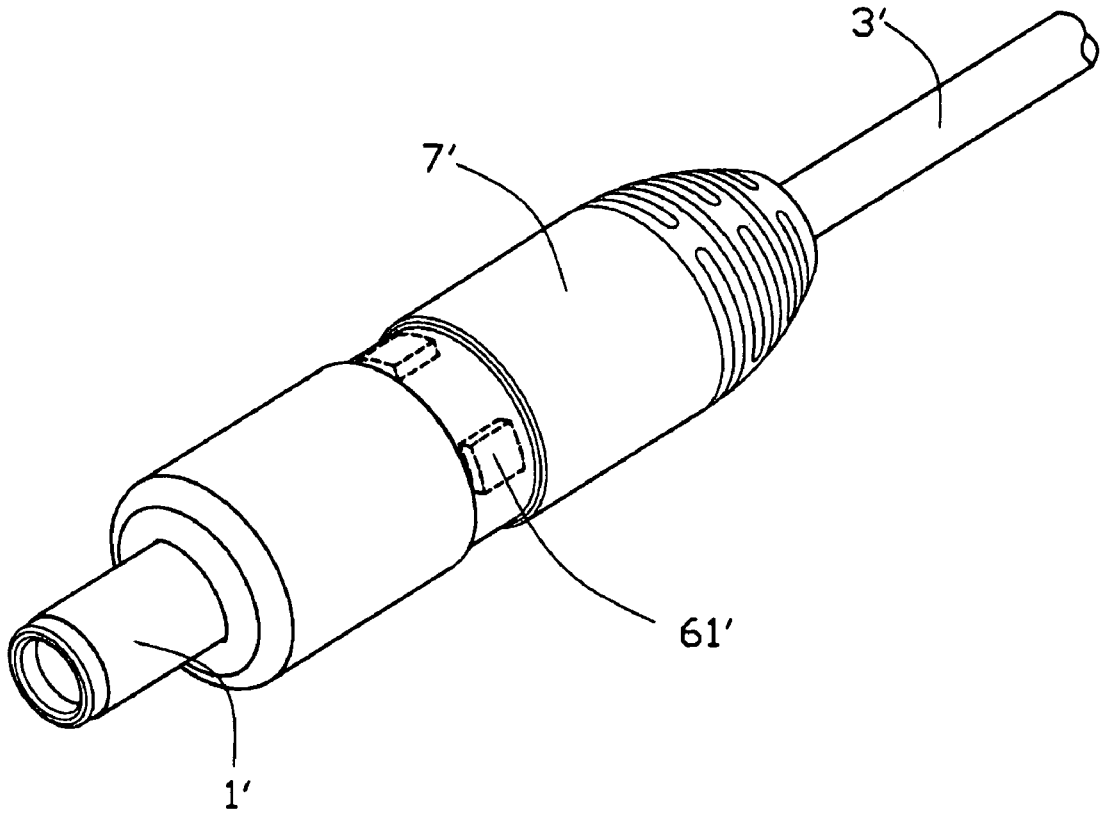
FIG. 9 is an assembled, perspective view of a power connector in accordance with the second embodiment of the present invention.

The outer cover 7 is molded over the inner insulator 5, rear portion of the mating plug 1 and front portion of the cable 3. The outer cover 7 defines four through holes (not labeled) in alignment with the view sections 61 of the light pipe 6. The view sections 61 are flush with outer peripheral face of the outer cover 7.

the second embodiment of the present invention is shown in FIG. 9, the power connector 100' of the second embodiment has the same configuration as that of the power connector 100 except that the outer cover 7' is made of transparent or semitransparent material. Therefore, the view sections 61 of the light pipe 6 are eyeable, and the user could view the indication of the LEDs 4. Correspondingly, the through holes corresponding to the view sections 61 are unnecessary. It is noticeable that the view sections 61 shown in FIG. 9 are illustrated by broken line for clearance purpose.

In application, when the power connector 100, 100' is mated with the complementary connector assembled to a Printed Circuit Board, a current path is established between the power connector 100, 100' and the PCB lia the complementary connector. If an electrical current circuit is achieved between the PCB and the power connector 100, 100', the LEDs 4 are on, otherwise the LEDs 4 are off, and the user could detect the indication of the LEDs 4 from the view sections 61 from all of the angle.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector matable with a complementary connector, comprising:

a mating plug matable with the complementary connector, the mating plug comprising a center signal terminal, first and second terminals for power transmission;

a circuit board connected to the mating plug;

a light-emitting diode assembled to the circuit board to indicate working status of the power connector; and a light pipe transmitting the light from light-emitting diode; wherein the light pipe defines four view sections, the view sections arranged in a common circle and averagely spaced from each other; wherein the power connector comprises an inner insulator receiving the circuit board therein; wherein the inner insulator defines four through apertures respectively receiving corresponding view sections therein.

2. The power connector as claimed in claim 1, wherein the inner insulator is formed with an upper half and a lower half joint with the upper part.

3. The power connector as claimed in claim 1, wherein the power connector comprises a dielectric outer cover partially enclosing the mating plug.

4. The power connector as claimed in claim 3, wherein the outer cover defines at least a through hole for detecting the status of the light-emitting diode.

5. The power connector as claimed in claim 1, wherein the mating plug comprises a center terminal for signal transmission.

6. The power connector as claimed in claim 1, wherein the mating plug is connectable with a cable.

7. A power connector matable with a complementary connector, comprising:

a mating plug matable with the complementary connector, the mating plug comprising a center signal terminal, first ad second terminals for power transmission;

a circuit board connected to the mating plug;

a cylindrical cover at least partially covering the mating plug and defining at least two through holes in two different radial direction;

a light-emitting diode assembled to the circuit board; and a circular light pipe transferring light, which is generated from the light-emitting diode, in an outward radial direction, and defining at least two view sections in two different radial directions; wherein the light-emitting diode is embedded in the cylindrical cover, the at least two view sections of the circular light pipe are received in the at least two through holes of the cylindrical cover, respectively, thus, the light of the light-emitting diode is eyeable from outside of the cylindrical cover at least in two different radial directions.

8. A power connector matable with a complementary connector, comprising:

a mating plug matable with the complementary connector, the mating plug comprising a center signal terminal, first and second terminals for power transmission;

a circuit board located behind the mating plug;

a cylindrical cover at least partially covering the mating plug;

a light-emitting diode assembled to the circuit board; and an arc-like light pipe transferring light which is generated from the light-emitting diode; wherein the light-emitting diode is embedded in the cylindrical cover while the light thereof is eyeable from outside of the cylindrical cover under a condition that the arc-like light pipe includes at least one projection extending outwardly in a radical direction and in radial alignment with a corresponding through hole formed in the cover.

9. The connector as claimed in claim 8, wherein said projection is received in the corresponding through hole.

10. The connector as claimed in claim 8, wherein there are two spaced and discrete projections of the light pipe, and two corresponding spaced and discrete through holes in the cover.

* * * * *